US007044581B2

(12) United States Patent
Shimoyama

(10) Patent No.: US 7,044,581 B2
(45) Date of Patent: May 16, 2006

(54) INK JET PRINTING APPARATUS AND INK JET PRINTING METHOD WITH AN AIR CURRENT GENERATING MEANS TO REMOVE INK MISTS GENERATED IN THE APPARATUS

(75) Inventor: Noburo Shimoyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 183 days.

(21) Appl. No.: 10/697,179

(22) Filed: Oct. 29, 2003

(65) Prior Publication Data

US 2004/0090486 A1 May 13, 2004

(30) Foreign Application Priority Data

Nov. 1, 2002 (JP) ..... 2002-320431

(51) Int. Cl.
*B41J 2/165* (2006.01)

(52) U.S. Cl. ..... 347/34

(58) Field of Classification Search ..... 347/18, 347/32, 101, 24, 36, 34, 22, 23, 30, 33, 35, 347/41, 44, 47, 29, 54, 102, 25
See application file for complete search history.

(56) References Cited

U.S. PATENT DOCUMENTS 5,406,316 A * 4/1995 Schwiebert et al. ..... 347/18
5,467,114 A * 11/1995 Ebinuma et al. ..... 347/32
5,552,812 A * 9/1996 Ebinuma et al. ..... 347/34
5,774,141 A * 6/1998 Cooper et al. ..... 347/34
2001/0020962 A1* 9/2001 Kanaya et al. ..... 347/24
2002/0167576 A1* 11/2002 Koitabashi et al. ..... 347/101
2002/0180854 A1* 12/2002 Sato et al. ..... 347/96
2004/0090486 A1* 5/2004 Shimoyama ..... 347/34

FOREIGN PATENT DOCUMENTS

JP 06-126952 5/1994
JP 06-166173 6/1994
JP 07-025007 1/1995

* cited by examiner

*Primary Examiner*—K. Feggins
*Assistant Examiner*—Rene Garcia, Jr.
(74) *Attorney, Agent, or Firm*—Morgan & Finnegan, LLP

(57) ABSTRACT

It is an object of the present invention to provide an ink jet printing apparatus which can appropriately remove ink mists generated in the apparatus and which can avoid wasteful energy consumption. Thus, the present invention provides an ink jet printing apparatus that carries out printing on a print medium using ink, the apparatus including an air current generating portion that generates air currents inside the printing apparatus, a determining section that determines driving conditions for the air current generating portion on the basis of information on the amount of ink to be provided per unit area of a print medium, and a control section that controls the air current generating portion in accordance with the driving conditions determined by the determining section.

8 Claims, 4 Drawing Sheets

INK JET PRINTING APPARATUS AND INK JET PRINTING METHOD WITH AN AIR CURRENT GENERATING MEANS TO REMOVE INK MISTS GENERATED IN THE APPARATUS

This application claims priority from Japanese Patent Application No. 2002-320431 filed Nov. 1, 2002, which is incorporated hereinto by reference.

BACKGROUND OF THE INVENTION

1. Field of the Invention

The present invention relates to an ink jet printing apparatus that carries out printing using ink.

2. Description of the Related Art

Printing apparatuses have functions for a printer, a copier, or a facsimile machine or are used as output equipment for composite electronic equipment or a workstation including a computer or a word processor. These printing apparatuses are configured to print images on printed materials (print media) such as paper or thin plastic sheets on the basis of image information. The printing apparatuses can be classified into an ink jet type, a wire dot type, a thermal type, a laser beam type, and others in terms of a printing method.

A serial type printing apparatus employs a serial scan method of moving the apparatus in a main scanning direction crossing a direction (sub-scanning direction) in which printed materials are conveyed. In this printing apparatus, printing means mounted on a carriage moving along the main scanning direction is used to print an image (main scanning). After one row has been printed, the printed material is conveyed a predetermined amount (pitch feed). Subsequently, the printed material is stopped again, and the next row of the image is printed (main scanning). These operations are alternately repeated to print the entire printed material.

On the other hand, a line type printing apparatus carried out printing simply by conveying a printed material (sub-scanning) and without moving the print head. In this printing apparatus, a printed material is set at a predetermined print position. One row is printed at a time, and then the printed material is conveyed a predetermined amount (pitch feed). Then, the next row is printed at a time. These operations are repeated to print the entire printed material.

Of the above printing apparatuses, a printing apparatus based on the ink jet method (ink jet printing apparatus) carries out printing by allowing printing means (the print head) to eject ink to a printed material for printing. The ink jet printing apparatus has a large number of advantages. For example, its printing means can be made smaller easily, and it can print an image with a high resolution at a high speed. Furthermore, the ink jet printing apparatus requires less running costs and involves less noise because of the use of a non-impact method. Moreover, the ink jet printing apparatus can easily print color images using a large number of color inks. In particular, printing operations can be performed at a higher speed using a line type printing apparatus that uses line type printing means having a large number of ejection openings arranged in the cross direction (main scanning direction) of printed media.

However, if a printing operation is performed using the ink jet method, then in addition to ink droplets contributing to image printing, fine ink droplets (ink mists) not contributing to image printing are ejected from the print head. The ink mists have small shapes and light weights and may flow in the air and adhere to various sites inside the apparatus in the form of stains. Furthermore, the ink mists adhering to a platen or a print sheet conveying guide member also adhere to print media in the form of stains. They may hinder the formation of appropriate print images. However, when the ink mists adhering to and accumulating on the platen, a print paper conveying roller, or the like become more viscous, the print medium cannot be smoothly conveyed. The print sheets maybe jammed or inappropriately conveyed, for example, they may be conveyed obliquely, wrinkled, or waved. Moreover, if ink mists adhere to the vicinity of a movable part such as a sliding shaft or bearing on a carriage, the movable part may undergo severer friction to disable normal operations.

Furthermore, if ink mists adhere to an encoder located near the carriage or an optical part such as a reflection type photo sensor used to detect the position of a print medium or the carriage, it becomes impossible to accurately monitor the position or speed of the carriage or print medium. Consequently, the apparatus cannot be operated correctly. If ink mists adhere to an electric part, the ink may cause a short circuit, corrosion of a structural part, or even damage to the printing apparatus, depending on the composition of the ink. Further troubles may occur. For example, the ink mists may fly out of the printing apparatus through an opening and adhere to and accumulate on a part such as a cover of the printing apparatus which may be touched by an operator or a work surface around the printing apparatus. Consequently, the periphery of the apparatus may be contaminated with the ink, or the operator may be stained with ink when scanning the printing apparatus.

To eliminate these disadvantages, an arrangement has been proposed in which a fan and a duct are provided near a printing section including the print head, the carriage, and the platen in order to generate air currents (refer to Japanese Patent Application Laid-Open Nos. 6-126952 (1994), 6-166173 (1994), and 7-025007 (1995)).

In connection with the ink jet printing apparatuses described in the above patent documents, a printer is proposed which is provided with a fan in order to facilitate the fixation of ink landing on a print medium and remove ink mists. The fan is controlled to operate only during printing operations.

However, with the conventional ink jet printing apparatus provided with the fan as described above, the driving of the fan is stopped simultaneously with the end of a printing operation or with the stoppage of the carriage. Alternatively, the fan is always driven. A problem with the former method is that the driving of the fan is stopped simultaneously with the stoppage of a printing operation even though ink mists floating in the printing apparatus have not been completely removed. A problem with the latter method is that the fan is driven even though ink mists have been completely removed, resulting in wasteful power consumption.

SUMMARY OF THE INVENTION

It is an object of the present invention to provide an ink jet printing apparatus which can appropriately remove ink mists generated in the apparatus and which can avoid wasteful energy consumption.

A first aspect of the present invention is an ink jet printing apparatus that carries out printing on a print medium using a print head applying ink, the apparatus being characterized by comprising air current generating means for generating air currents inside the printing apparatus, determining means for determining driving conditions for the air current generating means on the basis of information on the amount of ink to be provided per unit area of a print medium, and control means for controlling the air current generating means in accordance with the driving conditions determined by the determining means.

A second aspect of the present invention is an ink jet printing apparatus that carries out printing on a print medium using a print head applying ink, the apparatus being characterized by comprising air current generating means for generating air currents inside the printing apparatus, determining means for determining driving conditions for the air current generating means on the basis of information on a spacing between the print medium and a print head, and control means for controlling the air current generating means in accordance with the driving conditions determined by the determining means.

A third aspect of the present invention is an ink jet printing method of carrying out printing on a print medium using a print head applying ink, the method using a printing apparatus comprising providing air current generating means for generating air currents inside the printing apparatus, the method being characterized by comprising determining driving conditions for the air current generating means on the basis of information on the amount of ink to be provided per unit area of the print medium, and controlling the air current generating means in accordance with the determined driving conditions.

In the present invention, if a large amount of ink is provided per unit time owing to, for example, a high print duty or if spacing between the print medium and the print head are large, ink mists that may be generated in the apparatus are reliably removed by increasing the time for which the current generating means is driven and/or the amount of air currents generated per unit time. On the other hand, if no printing operations are performed or the amount of ink provided is such that no ink mists are likely to occur, the current generating means is stopped or the driving time and/or the amount of air currents generated is reduced. Consequently, according to the present invention, the ink mists can be appropriately removed and the current generating means can be efficiently driven. This makes it possible to reduce power consumption and noise.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below with reference to the drawings.

(First Embodiment)

First, a first embodiment of the present invention will be described with reference to FIGS. 1 to 4.

Figure 1:
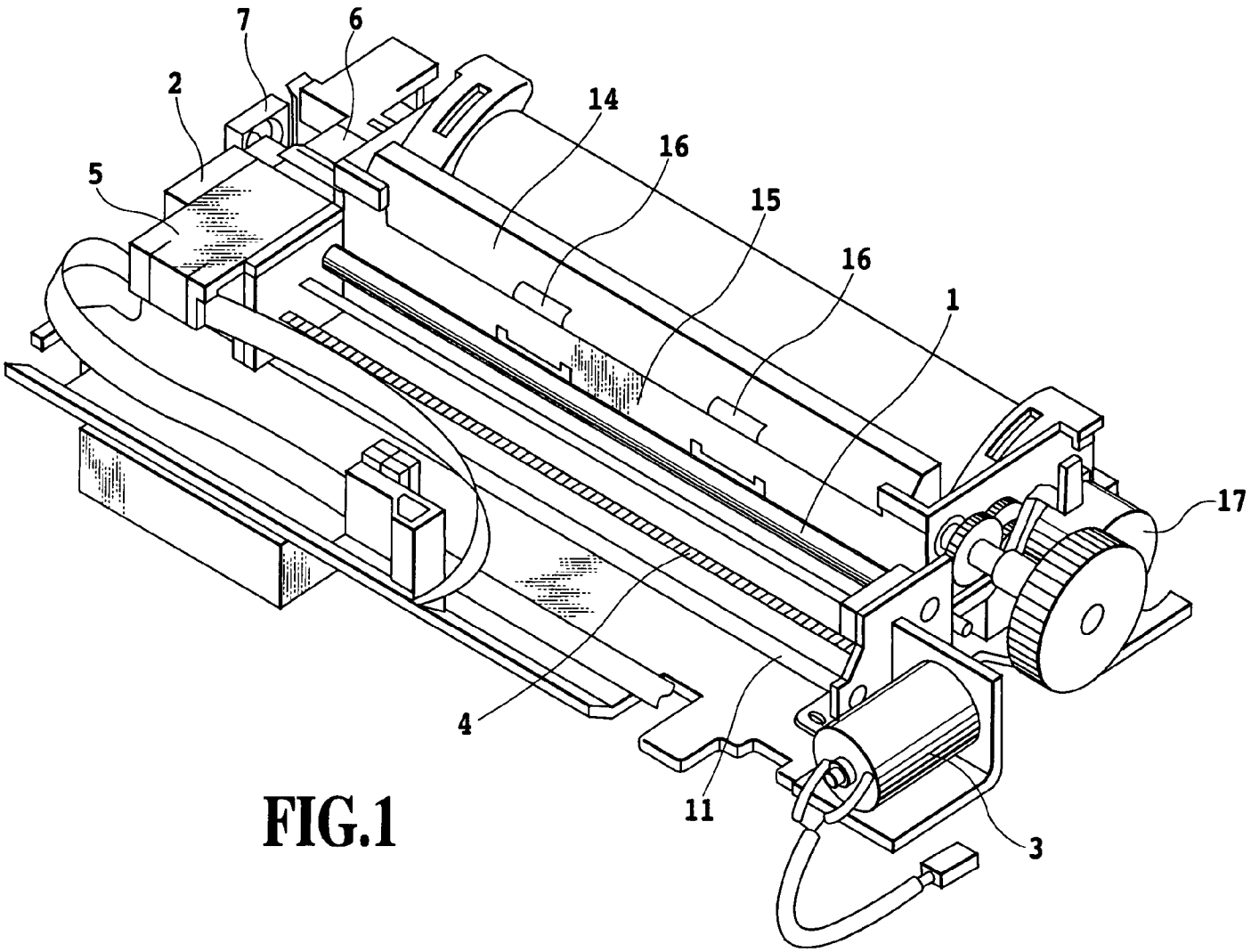
FIG. 1 is a perspective view showing the printing apparatus main body of an ink jet printing apparatus applied to embodiments of the present invention.

FIG. 1 is a perspective view schematically showing the appearance of an ink jet type printing apparatus as a first embodiment of the present invention. As shown in this figure, a carriage 2 is slidably attached to shafts 1 and 11 fixed to a frame of the ink jet printing apparatus. The carriage 2 is driven by a carriage motor 3 and a carriage belt 4 that are carriage driving means, to reciprocate along the shafts 1 and 11. An ink jet head 5 as printing means according to the present embodiment is mounted on the carriage 2. A large number of nozzles are formed in the ink jet head 5 and contain respective energy generating elements such as heating elements which generate ink ejection energy. When any of the energy generating elements is driven in response to a print control signal, described later, the print head ejects ink from the nozzle corresponding to the driven driving element, for printing.

A home position is provided near one end of the moving range of the carriage 2 along the shafts 1 and 11. A head recovery unit 6 is provided at a position where it stands opposite a nozzle surface (not shown) of the ink jet head when the ink jet head 5 is located at the home position. Although not described in detail. The head recovery unit 6 performs a capping operation for preventing the nozzle from being dry while the head is not used, a forced ink sucking operation for recovering from inappropriate ejection caused by the clogging of the nozzles.

Furthermore, conveying means is composed of a platen 14, a paper presser plate 15 located opposite the platen 14, a roller 16 rotatably provided in the platen, and a conveying motor 17 that drives the roller. Print media are sandwiched between the paper presser plate 15 and the platen 14. When the conveying motor 17 rotates the roller 19 in association with the movement of the carriage 2 or printing by the ink jet head 5, the print media are intermittently conveyed to the upper part of the printing apparatus.

A fan 7 is provided near the home position of the carriage 2 as air current generating means for generating air currents in the printing apparatus main body. The printing apparatus main body of the ink jet printing apparatus according to this embodiment is composed of the mechanisms shown in FIG. 1 and a cover member (not shown) provided outside these mechanisms. An air current channel is formed in a space located inside the cover member around the carriage moving path so that air currents generated by the fan can flow through this channel. The air current path is composed of spaces including one near a print position within the print range of the carriage 2. The air current path is used to generate air currents at least near a print surface of a print medium.

In connection with the direction of air currents generated by the air current generating means, internal air is generally exhausted to the exterior together with ink mists. However, ink mists may be exhausted as a result of diffusion. Moreover, by switching the directions of suction and exhaust depending on the direction in which the carriage 2 advances, it is possible to prevent an extreme change in the relative speed between air currents formed in the printing apparatus main body and the carriage 2. This in turn makes it possible to suppress the adverse effects of air currents on ink ejected from the ink jet print head 5 during a printing operation. However, the switching of the direction air currents is desirably employed in accordance with the size or performance of the printing apparatus.

Figure 2:
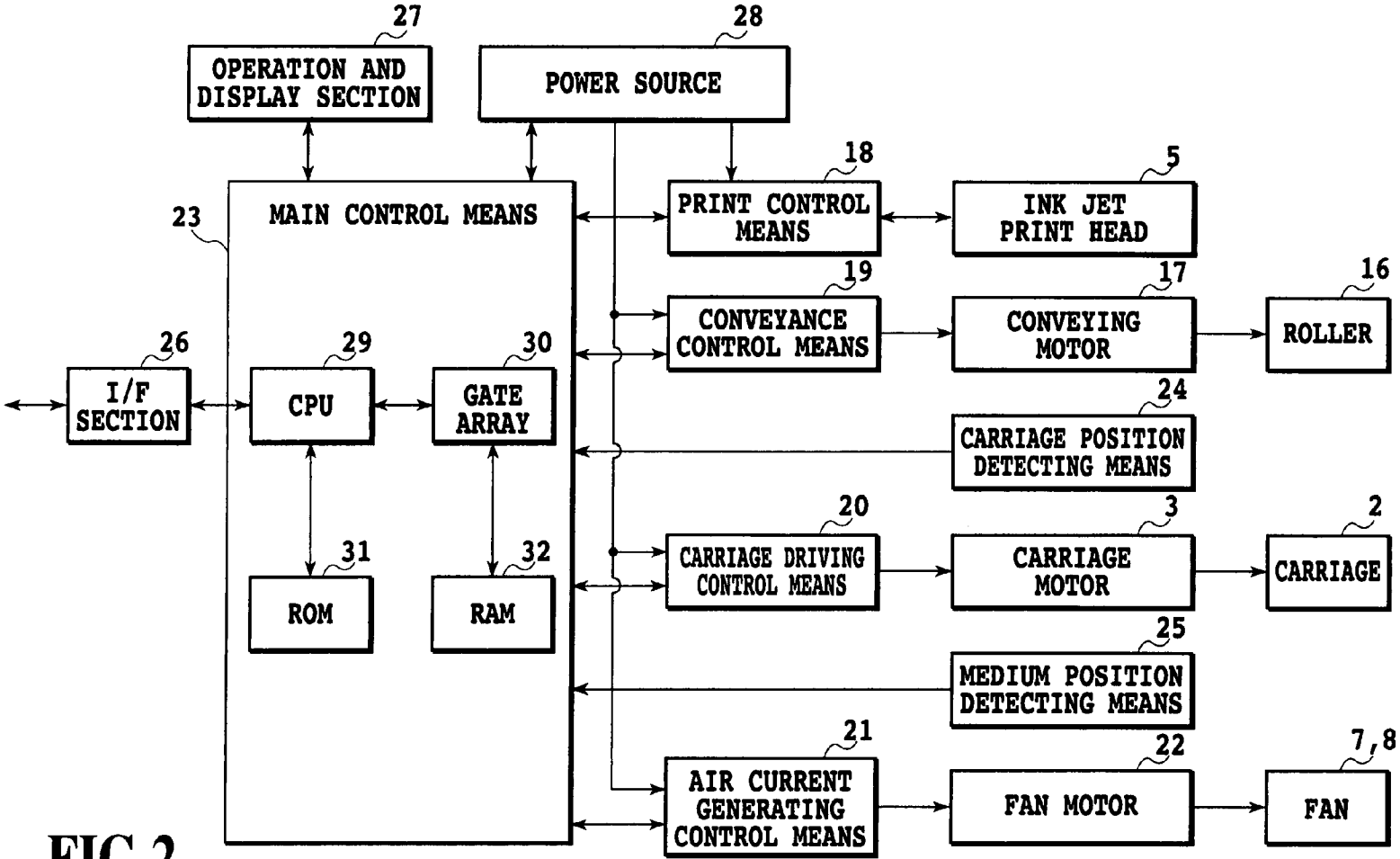
FIG. 2 is a block diagram showing the configuration of a control system according to the embodiments of the present invention.

FIG. 2 is a block diagram of a control system for the ink jet printing apparatus according to the present embodiment. Main control means 23 performing a control operation on the whole printing apparatus connects to the ink jet print head 5 via print control means 18, to a conveying motor 17 via conveyance control means 19, to a carriage motor 3 via carriage driving control means 20, and to a fan motor 22 via air current generating control means 21. The main control means 23 also connects to carriage position detecting means 24 for detecting the position of the carriage 2 and medium position detecting means 25 for detecting the position of a print medium. Furthermore, the main control means 23 connects to an I/F section (interface section) 26 for establishing connections to a host computer and a network and an operation and display section 27. Moreover, a power source 28 is provided to supply power to the main control means 23, the print control means 18, the conveyance control means 19, the carriage driving control means 20, and the current generating control means 21.

Now, each means will be described in detail.

The main control means 23 includes a ROM (Read Only Memory) 31, a CPU (Central Processing Unit) 29, a gate array 30, and a RAM (Random Access Memory) 32.

The ROM 31 stores control programs for various operations of the present ink jet printing apparatus. The CPU 29 provides functions as means for executing processes such as predetermined calculations (for example, the counting of dots in an area, described below), determinations, and control in accordance with the control programs stored in the ROM 31. The CPU 29 also provides a function as means for determining fan driving conditions, described later. The CPU 29 supplies control signals to the control means 18, 19, 20, and 21 to drive the ink jet head 5, the conveying motor 17, the carriage motor 3, and the fan motor 22. On receiving information from the carriage position detecting means 24 and the position detecting means 25, the CPU 29 transmits and receives signals to and from the operation and display section 27 and to and from the host computer via the I/F section 26. The host computer various signals for data on images to be printed, control commands, and the like, via the I/F section 26. The print control means 18 drivingly controls the ink jet print head 5. For example, it switches on and off a power supply to the ink jet print head 5, transfers and latches print data, dispatches a head enable signal, and controls temperature.

The conveyance control means 19 is composed of a motor drive that drives the conveying motor (stepping motor) used to convey print media, and other components.

The carriage driving control means 20 is composed of a motor driver that drives the carriage motor (stepping motor or DC motor) 3, used to convey the carriage 2. The carriage driving control means 20 also dispatches a carriage driving control signal to the air current generating control means 21.

The air current generating control means 21 switches on and off the fan motor 22 and controls the rotation speed and direction of the fan motor 22 and the like.

The operation and display section 27 includes a light emitting diode, a liquid crystal display, key switches, and the like. The operation and display means 27 uses the key switches to allow operations to be performed, including turning on and off the power switch on the printing apparatus main body and clearing an error. The operation and display means 27 also uses the light emitting diode and the liquid crystal display to display the status of the printing apparatus (a power on or off status, an online connection status, an error status, and the like).

The power source 28 supplies logic power to the main control means 23, motor power to the print control means 18, the conveyance control means 19, the carriage driving control means 20, and the air current generating control means 21, and head driving power to the print control means 18. The main control means 23 controls the power source 28 to turn on and off these power supplies.

The position detecting means 25 is composed of a photo interrupter, a reflection type photo sensor, or the like. The position detecting means 25 detects a print start and end positions on a print medium as well as errors such as inappropriate conveyance of print paper and transmits the detection information to the CPU 23.

The carriage position detecting means 24 monitors the position of the carriage 2 on which the ink jet head 5 is mounted. The carriage position detecting means 24 then transmits monitor information to the CPU 23. For example, the carriage position detecting means 24 has an encoder or the like which always checks the position of the carriage 2 and determining means for determining whether or not the carriage 2 is actually located at the desired position, and if not, dispatching an error signal to the control means.

Figure 3:
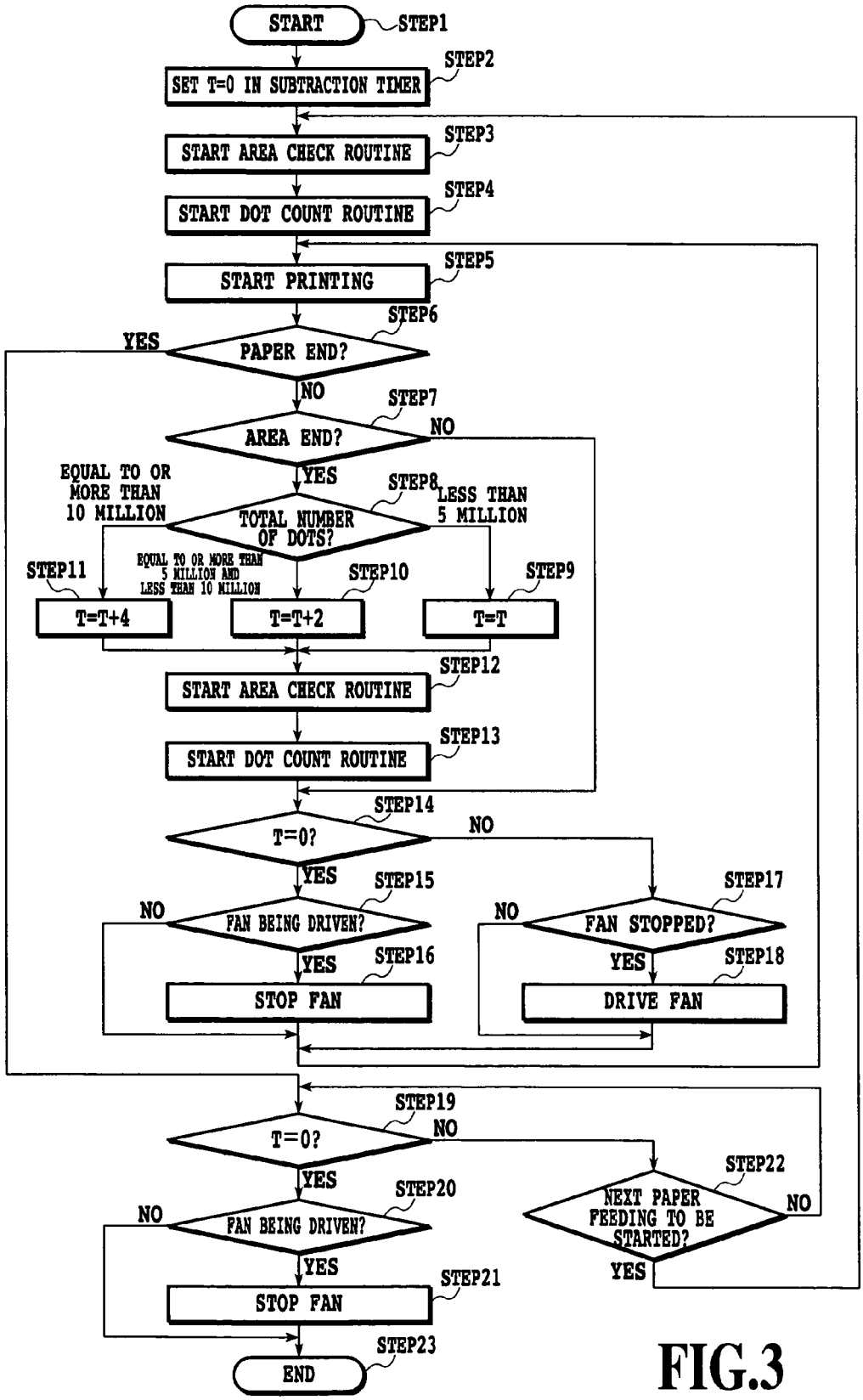
FIG. 3 is a flow chart showing an operation according to a first embodiment of the present invention.

Now, an operation of the present embodiment will be described with reference to the flow chart in FIG. 3.

First, at STEP1, the printing apparatus is powered on. Then, at STEP2, a time T in a subtraction timer that counts the remaining time for which the fan is driven is set to zero. Then, at STEP3, an area check is started to manage the amount of print medium fed by rotation of the conveying motor 17. In the present embodiment, area management is carried out every inch to determine whether or not the print position has reached an area end. Here, one area has a vertical (conveying direction) length of 1 inch and a horizontal (main scanning direction) length equal to a print width. At STEP4, a dot count routine is started to count the number of print dots in each area. The count is used to determine the fan driving time. That is, in the present embodiment, a dot counter process is executed using, as a unit, an area having a vertical (conveying direction) length of 1 inch and a horizontal (main scanning direction) length equal to a print width. This dot count process is executed by the CPU 29 in the printing apparatus.

Furthermore, at STEP5, a printing operation is started, and at STEP6, a paper end sensor (not shown) determines whether or not the trailing end of the print medium has been detected. If the trailing end has been detected, the process proceeds to STEP19. If the trailing end has not been detected, the process proceeds to STEP7 to determine whether or not an area end has been reached. If the area end has not been reached, the process proceeds to STEP14. If the area end has been reached, the process proceeds to STEP8. At STEP8, the total number of print dots in the area is counted. The process then proceeds to STEP9, STEP10, or STEP11 depending on the number of dots, to re-set the fan driving time. Specifically, if the total number of print dots in the area is less than 5 million, the process proceeds to STEP9 to set the fan driving time to T, with the value in the subtraction timer remaining unchanged. If the total number of print dots is equal to or more than 5 million and less than 10 million, the process proceeds to STEP10 to set T to T+2 to add 2 seconds to the value in the subtraction timer. If the total number of print dots is equal to or more than 10 million, the process proceeds to STEP11 to set T to T+4 to add 4 seconds to the value in the subtraction timer. That is, if the value in the subtraction timer (remaining number) is 6.5 seconds, a new value in the subtraction time will be 6.5+4=10.5 seconds.

After the value in the subtraction time has been re-set, the process proceeds to STEP12 to start (reset) an area check routine. The process further proceeds to STEP13 to start (reset) a dot count routine.

Then, at STEP14, it is determined whether or not the remaining number in the subtraction time is zero. If it is zero, the process proceeds to STEP15 to determine whether or not the fan 7 is driving. If the fan is being driven, then at STEP16, the fan 7 is stopped and then the process returns to STEP5. If the fan 7 is not being driven, the process returns directly to STEP5. On the other hand, if at STEP14, the remaining number in the subtraction timer is not zero, the process proceeds to STEP17. If the fan 7 is stopped, then at STEP18, the fan 7 is driven. If the fan 7 is not stopped, the process returns directly to STEP5.

On the other hand, if at STEP6, the paper end is detected, the process shifts to an operation of driving the fan 7 which operation is preformed after a paper discharge operation and in and after STEP19. At STEP19, it is determined whether or not the remaining number T in the subtraction timer is zero. If it is zero, the process proceeds to STEP20 to determine whether or not the fan 7 is being driven. If it is determined that the fan 7 is being driven, the fan 7 is stopped at STEP21 and the apparatus then starts to stand by. If the fan 7 is not being driven, the process proceeds directly STEP23 to cause the apparatus to stand by.

On the other hand, if at STEP19, the remaining number T in the subtraction timer is not zero, the process proceeds to STEP22 to determine whether or not the next paper feeding has been started. If it has been started, the process returns to STEP3. That is, in this case, the paper feeding is started even though the subtraction timer indicates that the fan driving time is not over yet (T is not zero). Accordingly, the fan 7 remains driven. On the other hand, if at STEP22, the paper feeding has not been started, the process returns to STEP19.

Thus, in the present embodiment, the driving time for the fan 7 as air current generating means is controlled on the basis of the number of print dots in an area. Specifically, if it is assumed that a large amount of ink mists will be generated, i.e. there are a large number of dots in the area, the fan driving time is set to be longer. On the other hand, if it is assumed that only a small amount of ink mists will be generated, i.e. there are only a small number of dots in the area, the fan driving time is set to be shorter. This enables ink mists to be appropriately removed from the apparatus and also prevents the unwanted driving of the fan 7. It is thus possible to reduce wasteful power consumption as well as running costs.

(Second Embodiment)

Now, a second embodiment of the present invention will be described with reference to the drawings. The second embodiment is configured as shown in FIGS. 1 and 2 as in the case with the first embodiment.

Figure 4:
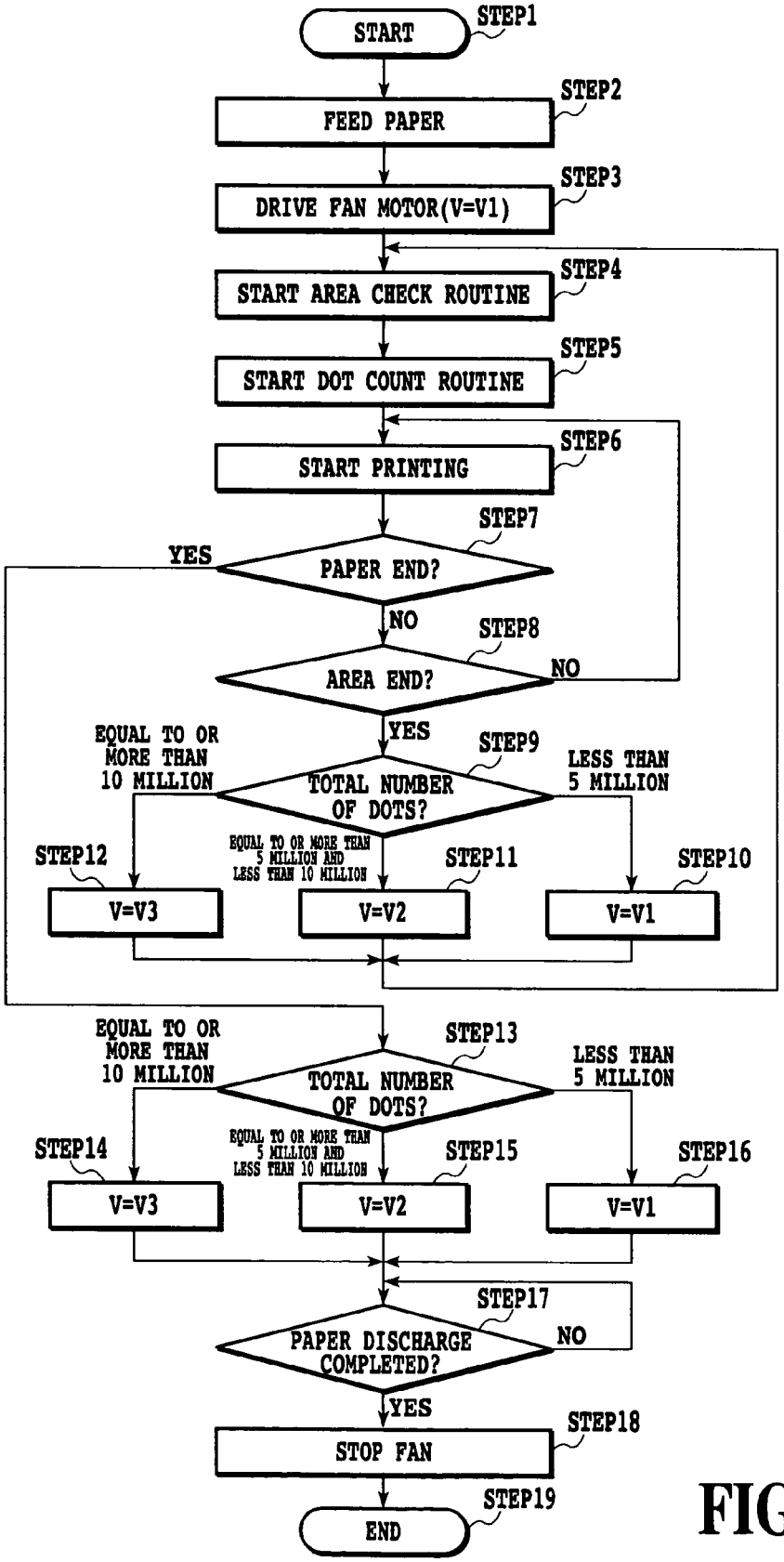
FIG. 4 is a flow chart showing an operation according to a second embodiment of the present invention.

With reference to the flowchart in FIG. 4, description will be given of a control operation according to the second embodiment.

First, when the printing apparatus is powered on at STEP1, a paper feeding operation is performed at STEP2. Subsequently, at STEP3, a voltage V1 is provided to the fan motor 22 as a driving voltage V to rotate the fan 7. Then, at STEP4, an area check is started to manage the amount of print medium fed by rotation of the conveying motor 17. In the second embodiment, area management is carried out every inch to determine whether or not the print position has reached the area end. At STEP5, the dot count routine is started to count the number of dots in each area. The count obtained is used to determine the fan driving time.

At STEP6, a printing operation is started and at STEP7, whether or not the paper end sensor (not shown) has detected the trailing end of the print medium is determined. If the trailing end has been detected, the process proceeds to STEP13. If the trailing end has not been detected, the process proceeds to STEP8 to determine whether or not the area end has been reached. If it is determined at STEP 8 that the area end has not been reached, the process returns to STEP6 to continue the printing operation. On the other hand, if the area end has been reached, the process proceeds to STEP9 to count the total number of print dots printed in the area. Depending on the number of dots, the process proceeds to STEP9, STEP10, or STEP11 to re-set the fan driving time.

Specifically, if the total number of print dots in the area is less than 5 million, the process proceeds to STEP9 to set the driving voltage V for the fan motor 22 to V1; an initialized status remains unchanged. If the total number of print dots is equal to and more than 5 million and less than 10 million, the process proceeds to STEP10 to set the driving voltage V for the fan motor 22 to V2. If the total number of print dots is equal to or more than 10 million, the process proceeds to STEP1 to set the driving voltage V for the fan motor 22 to V3. In general, the fan motor 22 is composed of a DC motor and its rotation speed is proportional to the voltage inputted to it. Accordingly, by changing the input voltage (driving voltage) to the fan motor 22, it is possible to change the rotation speed of the fan motor, i.e. the number of rotations of the fan 7 per unit time and thus the amount of air blown by the fan 7 (the amount of air currents generated). In this case, a choice is made from the three driving voltages V1, V2, and V3. Their magnitudes are in the order of V1<V2<V3.

After the driving voltage for the fan motor 22 has been re-set as described above, the process returns to STEP4 to start (reset) an area check routine. The process further proceeds to STEP5 to start (reset) a dot count routine.

On the other hand, if at STEP7, the trailing end of the print medium has been detected, then in and after STEP13, a driving process is executed on the fan 7, which is performing a paper discharge operation. Specifically, at STEP3, the total number of print dots printed from the start of the printing operation on the print medium till the detection of the trailing end of the print medium is determined. Then, the process proceeds to STEP14, STEP15, or STEP16 to re-set the fan motor driving voltage. If the total number of print dots is less than 5 million, then at STEP16, the driving voltage V is set to V1; the driving voltage V remains at its initialized value. If the total number of print dots is equal to and more than 5 million and less than 10 million, then at STEP14, the driving voltage V is set to V. This process is similar to the above determination of the number of print dots in the area.

Then, the process proceeds to STEP17 to determine whether or not the paper discharge has been completed. If it is determined that the paper discharge has been completed, the process proceeds to STEP18 to stop driving the fan 7. The process then proceeds to STEP19 to start starting by.

Thus, in the second embodiment, the driving voltage for the fan motor 22, which rotates the fan 7 as the air current generating means, is controlled on the basis of the number of print dots in the area. Specifically, if it is assumed that a large amount of ink mists will be generated, i.e. there are a large number of dots in the area, the driving voltage for the fan motor 22 is increased to increase the amount of air currents generated by the fan per unit time. On the other hand, if it is assumed that only a small amount of ink mists will be generated, i.e. there are only a small number of dots in the area, the driving voltage for the fan motor 22 is reduced to reduce the amount of air currents generated by the fan per unit time. This enables ink mists to be appropriately removed from the apparatus. It is also possible to prevent the unwanted or excessive driving of the fan 7 to reduce wasteful power consumption. As a result, running costs can be reduced.

(Third Embodiment)

In the first and second embodiments, the driving conditions for the air current generating means is determined on the basis of information on the number of print dots per unit area (each area). The present invention is not limited to this aspect.

That is, the amount of ink provided does not depend only on the number of print dots but also on other conditions (for example, an environment temperature or a head temperature). Specifically, the amount of ink provided tends to increase consistently with the environment temperature. In contrast, the amount of ink provided tends to decrease consistently with the environment temperature. That is, even with the same number of print dots, the amount of ink provided is relatively large when the environment temperature is high. In contrast, the amount of ink provided is small when the environment temperature is low. Accordingly, to determine more accurately the amount of ink provided per unit area, it is preferable to take into account not only the number of print dots but also other conditions (for example, the environment temperature or head temperature). Thus, a form of the present invention determine the driving conditions on the basis of information on the number of print dots and other conditions (for example, the environment temperature or head temperature).

Furthermore, the information on the number of print dots and the information on the number of dots and other conditions (for example, the environment temperature or head temperature) are related indirectly to the amount of ink provided. However, in the present invention, it is possible to use not only such indirect information but also information obtained by converting the indirect information into the amount of ink provided, i.e. information directly indicating the amount of ink provided.

As described above, in the present invention, the driving conditions may be determined on the basis of information on the amount of ink provided per unit time. The information on the amount of ink provided per unit area includes information on the number of print dots, information on the number of print dots and other conditions (for example, the environment temperature or head temperature), or information directly indicating the amount of ink provided. In short, the information on the amount of ink provided per unit area includes both information relating directly to the amount of ink provided per unit area and information relating indirectly to this amount.

(Fourth Embodiment)

In the above embodiments, the driving conditions (driving time, driving voltage, and the like) for the air current generating means are determined in accordance with the amount of ink provided per unit area. However, for ink jet printing apparatuses that allow the adjustment of the spacing between the print head and a print medium, it is also effective to control the driving conditions for the air current generating means in accordance with information on the spacing between the print head and the print medium in order to remove ink mists efficiently.

Specifically, in the ink jet printing apparatus, if the spacing between the print head and the print medium is set at a large value, a large amount of ink mists are likely to be generated. In contrast, if the spacing between the print head and the print medium is set at a small value, the amount of ink mists generated is reduced to a relatively small value. Thus, as described above, if the spacing between the print head and the print medium is set at a large value, the amount of air currents generated by the air current generating means such as a fan is increased. If the spacing between the print head and the print medium is set at a small value, a relatively small amount of air currents are generated. More specifically, If the spacing between the print head and the print medium is relatively large, then compared to the case where the spacing between the print head and the print medium is relatively small, the driving time for the air current generating means is increased, the driving voltage is increased, or these driving conditions are combined. This enables ink mists to be efficiently removed from the printing apparatus. In this case, the air current generating means is controlled by outputting spacing setting information in unison with well-known adjusting means for adjusting the spacing between the print head and the print medium or setting means so that the control means such as the CPU controls the fan motor or the like in accordance with the output information.

(Fifth Embodiment)

In the description of the first to fourth embodiments, ink mists are removed from the printing apparatus by being discharged to the exterior. However,the present invention is not limited to this form. For example, a filter may be provided which allows air to pass through, while collecting ink mists. In this case, the filter collects the ink mists to prevent them from being discharged to the exterior of the printing apparatus. Specifically, the filter may be suitably constructed by sticking non-woven fabrics composed of fibers to one another in the form of a honeycomb (a cross section of a corrugated cardboard).

(Other Embodiments)

In the above embodiments, the serial type printing apparatus has been described as an example of the printing apparatus main body. However, the present invention is also applicable to printing apparatuses other than the serial type, for example, line type printing apparatuses.

Furthermore, in the description of the above embodiments, the printing apparatus executes a dot count process and a process of determining the driving conditions (driving time, driving voltage, and the like) for the air current generating means. However, the host computer connected to the printing device may execute the dot count process and the process of determining the driving conditions. In this case, the host computer may execute a dot count process and transmit the results to the printing apparatus, which then determines the driving conditions. Alternatively, the host computer may execute both the dot count process and the process of determining the driving conditions and output the results to the printing apparatus.

Moreover, in the above first to third embodiments, the dot count process is executed using an area having a vertical (conveying direction) length of 1 inch and a horizontal (main scanning direction) length equal to the print width. The target area of the dot count process is not limited to this size. Furthermore, thresholds (less than 5 million dots, equal to or more than 10 million dots) as references compared with the result of dot counting and used to select the driving conditions (driving time, driving voltage, and the like) are not limited to the numerical values disclosed above.

It should be emphasized that a number of changes may be made to the embodiments without departing from the teachings of the present invention. In particular, all items included in the disclosure or the accompanying drawings should be construed as examples only and not as limitations. The scope of the present invention is determined on the basis of the claims.

What is claimed is:

1. An ink jet printing apparatus that carries out printing on a print medium using a print head for applying ink, the apparatus comprising:

air current generating means for generating air currents inside the printing apparatus;

determining means for determining driving conditions including a driving voltage for said air current generating means on the basis of information on the amount of ink to be provided per unit area of a print medium, and control means for controlling said air current generating means in accordance with the driving conditions determined by said determining means, wherein said determining means determines the driving voltage for said air current generating means in accordance with information on the amount of ink provided to the unit area of said print medium, and said control means drives said air current generating means using the driving voltage determined by said determining means.

2. The ink jet printing apparatus as claimed in claim 1, wherein said determining means determines the driving conditions for said air current generating means in accordance with the number of dots provided to said unit area.

3. The ink jet printing apparatus as claimed in claim 1, wherein said determining means determines a driving time for said air current generating means in accordance with the amount of ink provided to the unit area of said print medium, and said control means drives said air current generating means only for the driving time determined by said determining means.

4. The ink jet printing apparatus as claimed in claim 3, wherein the driving time for said air current generating means is determined to be longer as the amount of ink provided to said unit area increases.

5. The ink jet printing apparatus as claimed in claim 1, wherein said air current generating means includes a fan motor and a fan driven by the fan motor to let in outside air and carry out ventilation.

6. The ink jet printing apparatus as claimed in claim 1, wherein said air current generating means includes a fan motor and a fan driving by the fan motor to exhaust internal air to an exterior.

7. An ink jet printing apparatus that carries out printing on a print medium using a print head for applying ink, the apparatus comprising:

air current generating means for generating air currents inside the printing apparatus;

determining means for determining driving conditions including at least one of a driving time and a driving voltage for said air current generating means on the basis of information on the amount of ink to be provided per unit area of a print medium, and control means for controlling said air current generating means in accordance with the driving conditions determined by said determining means, wherein said determining means determines at least one of the driving time and the driving voltage for said air current generating means in accordance with the information on the amount of ink provided per the unit area of said print medium, and said control means drives said air current generating means under the driving condition determined by said determining means, and wherein the amount of air currents generated per unit time is changed by changing at least one of said driving time and said driving voltage.

8. A method of controlling air current generating means provided in an ink jet printing apparatus to generate air currents inside the printing apparatus, the method comprising:

a determining step for determining driving conditions including a driving voltage for the air current generating means on the basis of information on the amount of ink to be provided per unit area of the print medium; and a controlling step for controlling said air current generating means in accordance with said determined driving condition, wherein said determining step determines the driving voltage for said air current generating means in accordance with information on the amount of ink provided to the unit area of said print medium, and said controlling step drives said air current generating means using the driving voltage determined by said determining step.

* * * * *

UNITED STATES PATENT AND TRADEMARK OFFICE

CERTIFICATE OF CORRECTION

PATENT NO. : 7,044,581 B2
APPLICATION NO. : 10/697179
DATED : May 16, 2006
INVENTOR(S) : Noboru Shimoyama It is certified that error appears in the above-identified patent and that said Letters Patent is hereby corrected as shown below:

In Item (75) on the Title Page, change "Noburo SHIMOYAMA" to --Noboru SHIMOYAMA--.

Signed and Sealed this

Fourth Day of December, 2007

JON W. DUDAS
*Director of the United States Patent and Trademark Office*